US006085901A

United States Patent [19]

Lin

[11] Patent Number: 6,085,901

[45] Date of Patent: Jul. 11, 2000

[54] GOLF CLUB BAG SHAFT MOUNT

[76] Inventor: Ming-Tsung Lin, 63, Fang Tsao Street, Chan Hua, Taiwan

[21] Appl. No.: 09/233,454

[22] Filed: Jan. 20, 1999

[51] Int. Cl.[7] ..... A63B 55/00; A63B 57/00

[52] U.S. Cl. ..... 206/315.6; 206/315.2; 206/315.3

[58] Field of Search ..... 206/315.2, 315.3, 206/315.6

[56] References Cited

U.S. PATENT DOCUMENTS

| | | | |
|---|---|---|---|
| 1,988,870 | 1/1935 | Hotze | 206/315.3 |
| 2,134,644 | 1/1938 | Borm | 206/315.3 X |
| 3,139,132 | 6/1964 | Shiller | 206/315.6 |
| 4,538,728 | 9/1985 | Lewis | 206/315.3 |
| 4,863,019 | 9/1989 | Lewis et al. | 206/315.3 |
| 5,947,282 | 9/1999 | Merrill et al. | 206/315.3 X |

*Primary Examiner*—Sue A. Waver
*Attorney, Agent, or Firm*—Rabin & Champagne, P.C.

[57] ABSTRACT

The invention herein relates to a golf club bag shaft mount having of a frame that is installed in the opening of a golf club bag as well as individual golf club shaft mounts. Each mount is a unitary fabricated body having groove formed in the interior, with a curvilinear surface along the top of the groove. Furthermore, formed at the top is a semicircular concave recess. There is a bolt hole on each of two sides of the mount. After the adjacent sides of the mounts and the enclosure panels are fastened using the bolt holes, the invention herein is securely installed into the opening of the golf bag. Following assembly, the golf club shafts are placed into the openings of the mounts and then the mounts are rotated 90 degrees clockwise to prevent shifting and shaft-to-shaft impact.

13 Claims, 5 Drawing Sheets

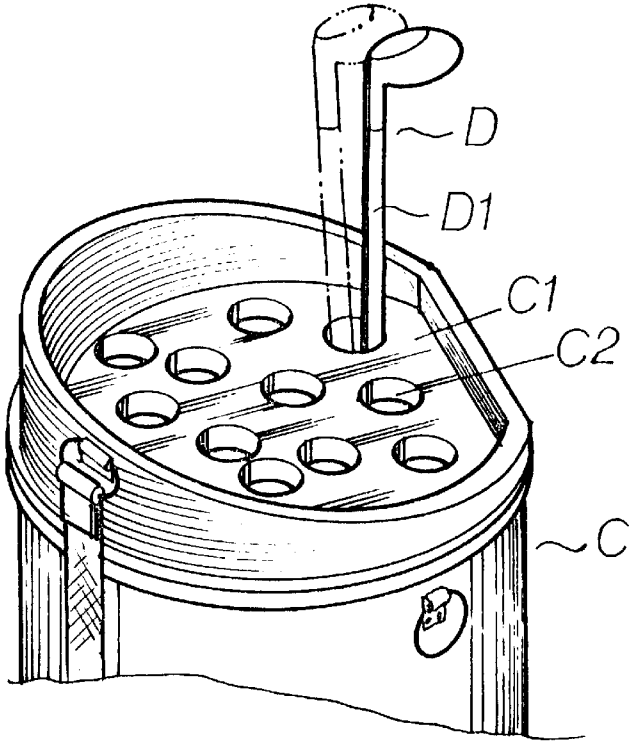
FIG.1-B
PRIOR ART
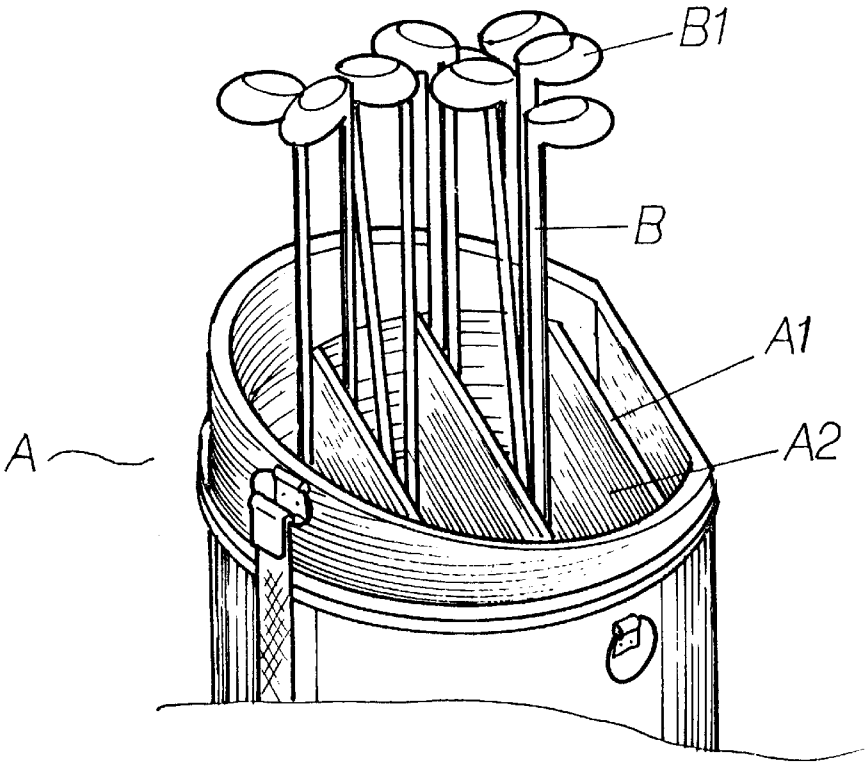
FIG.1-A
PRIOR ART

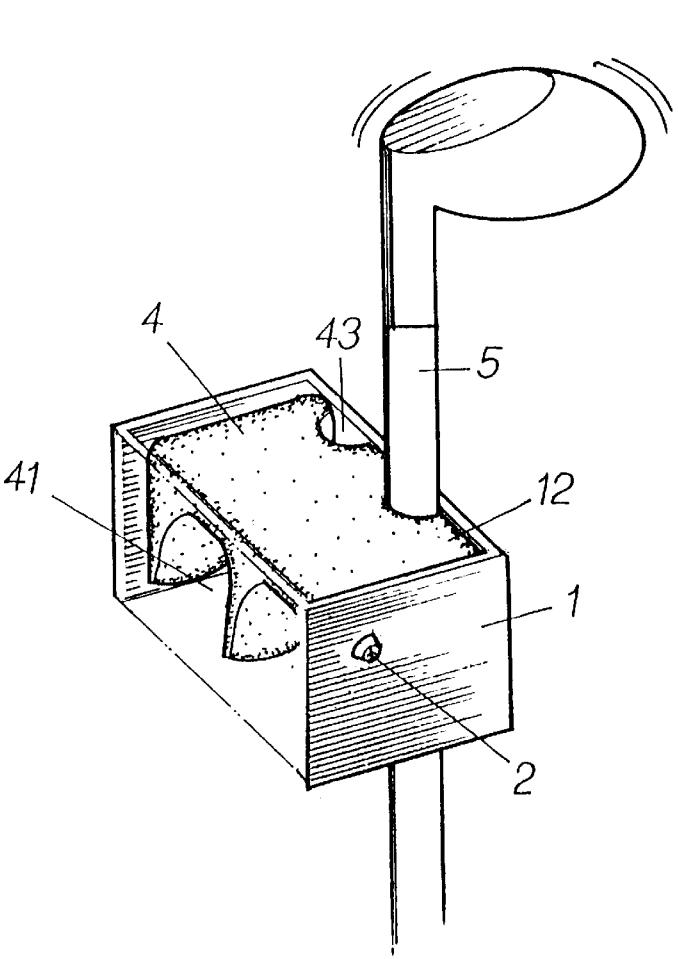
FIG. 4-B
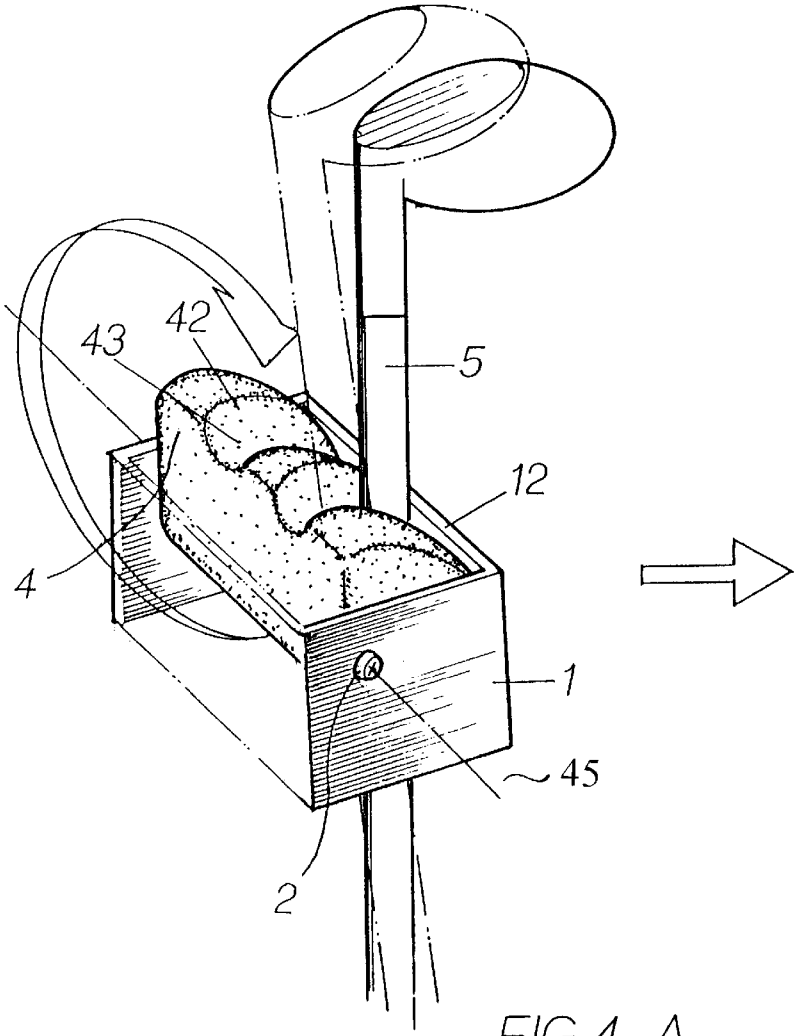
FIG. 4-A

GOLF CLUB BAG SHAFT MOUNT

BACKGROUND OF THE INVENTION

The invention herein relates to a kind of improved golf club bag shaft mount which anchors golf club shafts to prevent shifting and shaft-to-shaft impact following assembly and installation.

In most conventional golf club bags, referring to FIG. 1-A, there are dividers (A1) within the opening of the golf club bag (A) that partition a number of placement spaces (A2) for holding the golf clubs (B) in a certain order as utilized by the carrier. However, mutual shaft impact and other related phenomena occur when several golf clubs (B) are contained in the placement spaces (A2) and, furthermore, if the placement spaces (A2) are not completely occupied, the movement of the golf bag (A) causes the golf clubs (B) to shift laterally, exposing the heads of the golf clubs (B). As a result, not only do the golf clubs (B) scrape against each other, but the golf club heads (B1) become entangled, which presents utilization inconveniences and, furthermore, adversely affects interest in playing the game of golf. Furthermore, in another type of conventional golf club bag, referring to FIG. 1-B, there is planar body (C1) with openings that fits into the opening of golf club bag (C), specifically there are a number of placement holes (C2) formed in the surface of the planar body (C1) for containing the golf clubs (D). However, as might be observable in the drawing, the diameter of the placement holes (C2) is larger than the width of the golf club shafts (D1) and, therefore, as the golf club bag (C) is moved while being carried, the golf club shafts (D1) shift into a leaning position such that the heads and shafts inevitably collide when a full set of golf club shafts (D1) is contained. Therefore, regardless of how the golf club shafts are placed in the golf club bag, the golf club shafts remain subject to shaft-to-shaft abrasion and impact, with consequent deterioration in the quality of the golf club shaft.

Therefore, the applicant of the invention herein presents the disclosure of the invention herein, which is hereby submitted as an original invention in application for the granting of the commensurate patent rights.

SUMMARY OF THE INVENTION

The primary objective of the invention herein is to provide a kind of improved golf club bag shaft mount that includes of a frame installed in the opening of the golf club bag as well as individual golf club shaft mounts, with the aforesaid mounts each having an opening formed in the interior, with a curvilinear surface along the top of the opening and, furthermore, formed at the top is a semicircular concave opening, and there is a bolt hole on each of the two sides.

To enable a further understanding of the structure and innovations of the invention herein, the brief description of the drawings below are followed by the detailed description of the invention herein.

BRIEF DESCRIPTION OF THE DRAWINGS

FIG. 1-A is an isometric drawing of a conventional embodiment.

FIG. 1-B is an isometric drawing of another conventional embodiment.

FIG. 4-A is an isometric drawing of the invention herein during rotation.

FIG. 4-B is an isometric drawing of the invention herein after rotation.

DETAILED DESCRIPTION OF THE INVENTION

Figure 2:
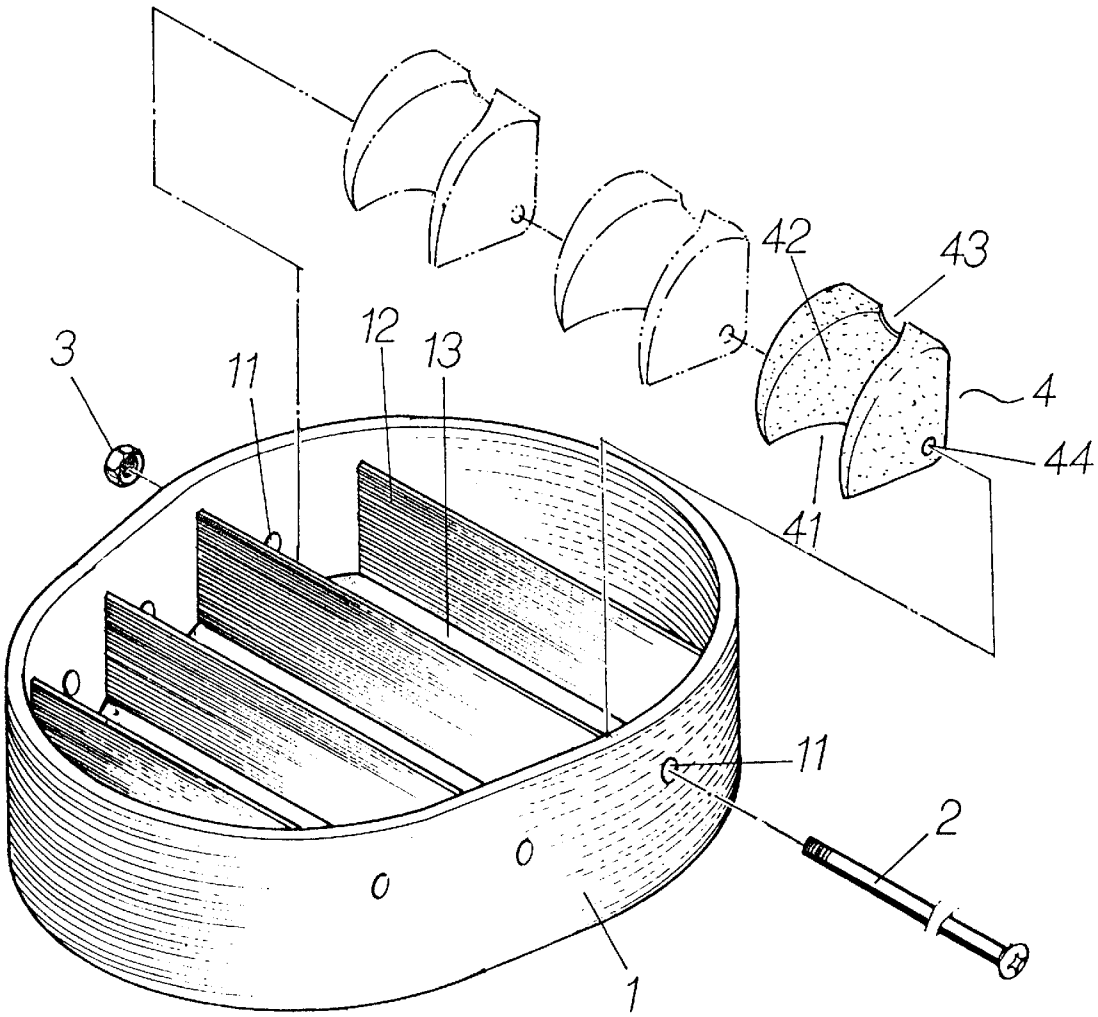
FIG. 2 is an exploded drawing of the invention herein.

Referring to FIG. 2, the improved golf club bag shaft mount of the invention herein is comprised of a frame (1), bolts (2), and nuts (3) that are installed in the opening of a golf club bag. There are a number of holes (11) along the periphery of aforesaid frame (1) as well a skirted border. Furthermore, there are placement spaces (13) formed by a number of divider plates (12) in the interior section. The aforesaid mount (4) is a unitary fabricated body having a groove (41) formed in the interior of the mount. The groove has a curvilinear surface (42); and, Furthermore, formed at the top end of the groove 41 is a semicircular concave recess (43). There is a bolt hole (44) on each of two sides of the aforesaid mount (4). To complete the assembly of the invention herein, the bolts (2) are inserted through the holes (11) along the periphery of the frame (1) and through bolt holes (44) of the mount (4). Then the nuts (3) are tightened to secure the mounts (4) within the placement spaces (13) (see FIG. 3). When assembly is completed, as indicated in FIG. 4, the golf club shafts (5) are placed into the grooves (41) of the mounts (4), and then the mounts (4) are rotated 90 degrees clockwise about an axis of rotation 45 from a first position (FIG. 4-A) to a second position (FIG. 4-B), so that the curvilinear surfaces (42) along the of the grooves (41) push the golf club shafts (5) toward the semicircular concave recesses (43) at the top of the mounts (4), as shown in FIG. 4-B, such that the golf club shafts (5) are anchored and thereby prevented from shifting as well as from scraping, impact and other similar situations likely to occur between golf club shafts.

Figure 3:
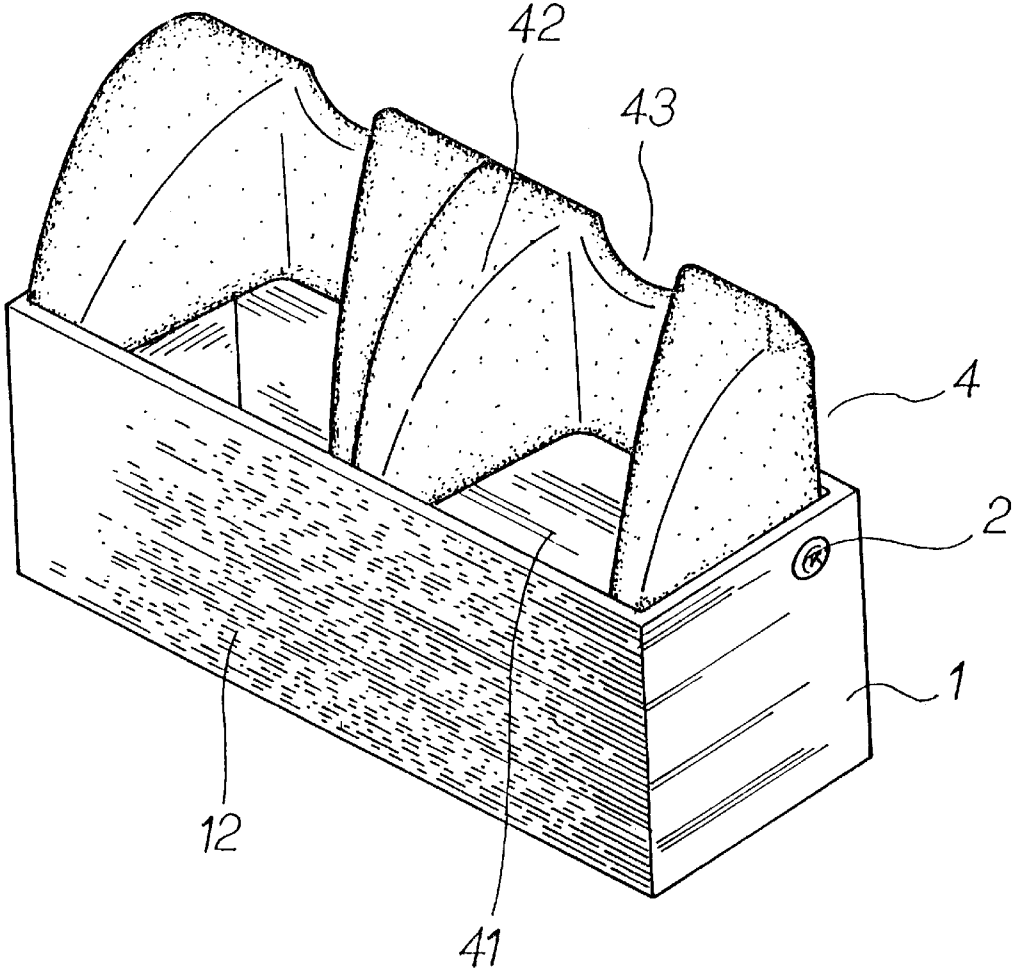
FIG. 3 is an isometric drawing of the invention herein strung together.
Figure 5:
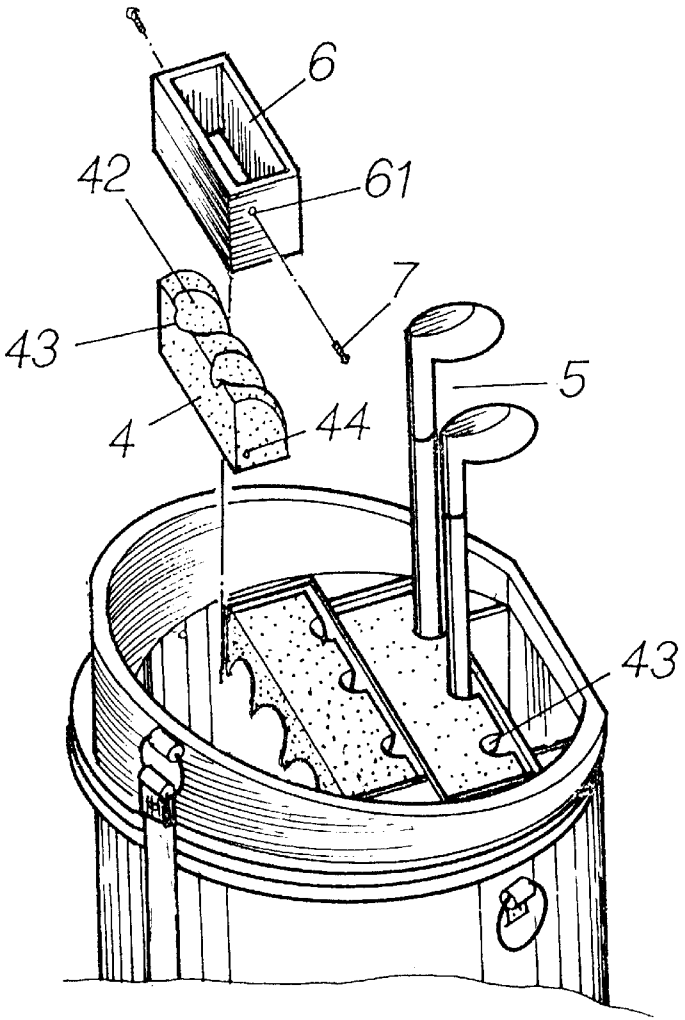
FIG. 5 is an exploded drawing of an embodiment of the invention herein.

Furthermore, the aforementioned mount (4) can be increased in number (two or more) by re-arranging as required based on the shape and dimensions of the frame (1), and configured into a single integrated row or several rows in an integrated square or round format, as shown in FIG. 3. Furthermore, the curvilinear surface (42) along the top of the groove (41) can also be a slanted surface. Referring to FIG. 5, the aforesaid mount (4) can be equipped with an enclosure frame or panel (6) and screws (7). There is a screw hole (61) situated at the edge of each enclosure panel (6) such that after the enclosure panels (6) are fitted over the mounts (4), the screws (7) are inserted through the screw holes (61) of the enclosure panel (6) and tightened in the bolt holes (44) in the mounts (4), and following the completion of assembly installed into the opening of the golf bag.

In summation of the foregoing description, the structure of the invention herein meets the requirements of an original patent and is hereby submitted in application for the granting of the commensurate patent rights.

What is claimed is:

1. An improved shaft mount for a golf club bag, comprising:

a frame installable in an opening of a golf club bag;

at least one mount positioned within said frame, said mount having an interior surface formed in a shape of a groove, the groove accommodating therein a shaft of a golf club, said mount further having a semicircular recess formed at a top thereof, the recess being in communication with the groove; and a plurality of fasteners pivotally holding said mount to said frame, each fastener being disposed on opposite sides of said mount so that the groove is disposed therebetween;

wherein said mount is rotatable within said frame from a first position to a second position about an axis of rotation that is perpendicular to a direction in which the groove extends;

wherein the shaft of the golf club is placeable within the groove, when said mount is in the first position;

wherein the rotating of said mount about the axis of rotation and toward the second position causes the interior surface to push the shaft of the golf club into engagement with the semicircular recess; and wherein the semicircular recess of said mount anchors the shaft of the golf club within said frame, when said mount is in the second position, thereby preventing the shaft of the golf club from shifting, scraping and impacting.

2. The shaft mount recited in claim 1, wherein the groove extends in a curvilinear direction, the groove terminating at the semicircular recess formed in said mount.

3. The shaft mount recited in claim 1, wherein said frame has a plurality of holes formed in a periphery thereof, and wherein said mount has a hole formed in each of the opposite sides thereof, said fasteners being disposed within the respective holes in said frame, and in the respective holes in said mount to hold said mount to said frame.

4. The shaft mount recited in claim 3, wherein said fasteners comprise bolts held within the respective holes using nuts.

5. The shaft mount recited in claim 1, further comprising a plurality of divider plates disposed within said frame to divide said frame into a plurality of placement spaces, said mount being disposed within a respective placement space.

6. The shaft mount recited in claim 1, wherein said mount is a unitary fabricated body.

7. The shaft mount recited in claim 1, wherein the interior surface of said mount is a curvilinear surface.

8. The shaft mount recited in claim 1, wherein said mount is rotatable 90 degrees from the first position into the second position.

9. The shaft mount recited in claim 1, wherein said at least one mount comprises a plurality of mounts, said plurality of mounts being disposed adjacent to one another in at least one row.

10. The shaft mount recited in claim 9, wherein said plurality of mounts are collectively positioned in one of a square and a round configuration.

11. The shaft mount recited in claim 1, wherein the interior surface of said mount is a slanted surface.

12. The shaft mount recited in claim 1, wherein said frame comprises an enclosure frame in form fitting engagement with said mount.

13. The shaft mount recited in claim 12, wherein said enclosure frame has a rectangular configuration.

* * * * *